US009718204B2

(12) United States Patent
Eichenauer

(10) Patent No.: US 9,718,204 B2
(45) Date of Patent: Aug. 1, 2017

(54) CHAIN-TYPE CUTTING ASSEMBLY

(71) Applicant: ALBRECHT BAEUMER GmbH & CO. KG, Freudenberg (DE)

(72) Inventor: Andreas Eichenauer, Niederfischback (DE)

(73) Assignee: ALBRECHT BAEUMER GMBH & CO. KG, Freudenberg (DE)

( * ) Notice: Subject to any disclaimer, the term of this patent is extended or adjusted under 35 U.S.C. 154(b) by 0 days.

(21) Appl. No.: 14/881,309

(22) Filed: Oct. 13, 2015

(65) Prior Publication Data

US 2016/0121504 A1 May 5, 2016

(30) Foreign Application Priority Data

Oct. 30, 2014 (DE) ..... 20 2014 105 205 U

(51) Int. Cl.
*B26D 7/26* (2006.01)
*B27B 33/14* (2006.01)
*B26D 3/00* (2006.01)

(52) U.S. Cl.
CPC ..... *B26D 7/2614* (2013.01); *B26D 3/003* (2013.01); *B26D 3/006* (2013.01); *B27B 33/142* (2013.01)

(58) Field of Classification Search
CPC ..... B26D 7/2614; B26D 3/003; B26D 3/006; B27B 33/142; B27B 17/14; B28D 1/082; B28D 1/124; B28D 1/08
USPC ... 83/796, 830–834, 31, 32, 33, 34, 853, 54, 83/85, 676, 839–845; 125/21, 592; 144/244, 34.1
See application file for complete search history.

(56) References Cited

U.S. PATENT DOCUMENTS 2,190,000 A 2/1940 Stenger et al.
2,608,222 A * 8/1952 Jensen ..... B27B 33/141 83/834
2,869,534 A * 1/1959 Stihl ..... B28D 1/124 125/21
3,263,717 A * 8/1966 Silvon ..... B27B 33/14 83/834

(Continued)

FOREIGN PATENT DOCUMENTS

DE 3413513 A1 3/1985
JP 02081811 A 3/1990

(Continued)

*Primary Examiner* — Ghassem Alie
(74) *Attorney, Agent, or Firm* — Andrew Wilford

(57) ABSTRACT

An assembly for cutting foam, nonwoven, rubber, and composite products has a guide having a longitudinally extending guide edge formed with a longitudinally extending and outwardly open groove. A longitudinally extending row of cutting elements extends along the guide edge, and element each has an entrainment dog projecting inward into the groove, a support riding on the guide edge and having sides each formed with a pair of longitudinally spaced and outwardly open recesses, a base outward of the support, and a wedge-section cutting tooth forming a cutting edge outside the base and having a pair of longitudinally extending flanks converging at the cutting edge. Coupling links extend between and have ends set in the recesses of adjacent cutting elements. Pivot pins extend through the ends of the links and through the supports at the bases. The base is of a maximum width greater than a width of the assembly at the pins.

8 Claims, 1 Drawing Sheet

(56) References Cited

U.S. PATENT DOCUMENTS

| | | | | |
|---|---|---|---|---|
| 4,393,739 | A * | 7/1983 | Olmr | B27B 33/142 30/138 |
| 4,898,057 | A * | 2/1990 | Hille | B27B 33/14 83/831 |
| 5,129,160 | A | 7/1992 | Bell | |
| 5,184,598 | A * | 2/1993 | Bell | B28D 1/124 125/21 |
| 6,435,070 | B1 * | 8/2002 | Weber | B23D 63/168 83/830 |
| 2008/0110317 | A1 | 5/2008 | Osborne et al. | |
| 2013/0269673 | A1 | 10/2013 | Buchholtz et al. | |

FOREIGN PATENT DOCUMENTS

| | | | |
|---|---|---|---|
| JP | 04042366 | A | 2/1992 |
| WO | 2012143419 | A | 10/2012 |

* cited by examiner

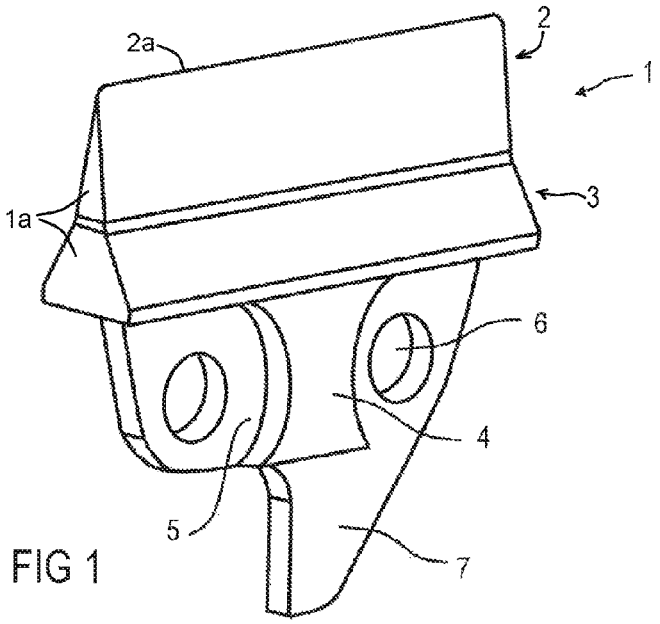
FIG 1
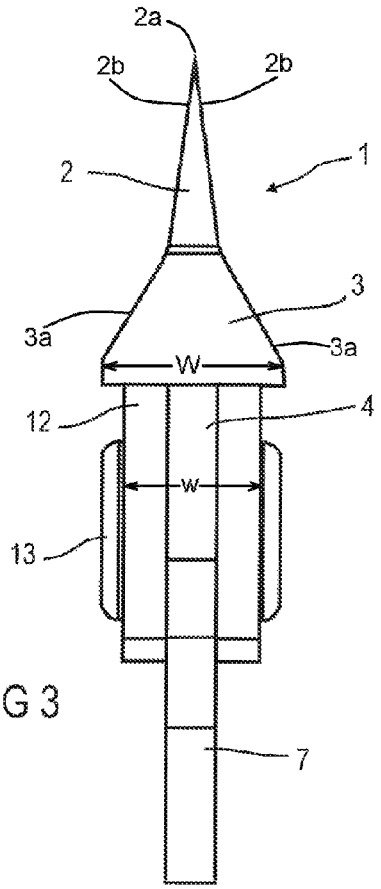
FIG 3
FIG 2
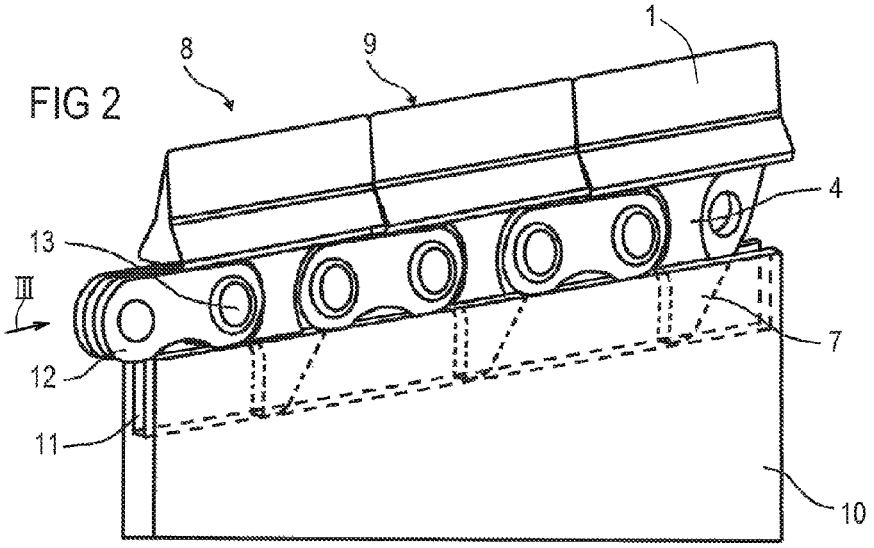

CHAIN-TYPE CUTTING ASSEMBLY

FIELD OF THE INVENTION

The present invention relates to a chain-type cutting assembly. More particularly this invention concerns such an assembly fur cutting rigid foam, fleece, rubber, or laminates.

BACKGROUND OF THE INVENTION

A typical assembly for cutting foam, nonwoven, rubber, and composite products has a row of multiple cutting elements formed as interconnected links of a cutting chain, and comprising a chain guide that is engaged by pusher dogs of the cutting elements acting as drive and guide components.

EP 2 699 394 (WO 2012/143419) discloses a saw chain for an apparatus for cutting plastic products and having cutting elements that each include a cutting edge base that supports a specially designed cutting tooth with two cutting edges on the ends thereof. The cutting angle for the desired generation of chips was reduced in such a way that a short chip is produced, and less material is removed due to the flatter cutting angle. Nevertheless, saw chains of this type still cut plastic products so as to entail a detrimentally substantial removal of material.

U.S. Pat. No. 5,129,160 describes a chain saw comprising a guide rail, a drive means to drive a saw chain around the guide rail, and an advancing mechanism that uses a pivotably mounted arm to produce a pushing motion of the chain saw along a longitudinal axis of the guide rail toward the workpiece by moving the arm relative to the chain saw. The arm is pivotably mounted on the chain saw at one of the end sections of the arm and is disposed on the other end section so as to enable it to directly engage the workpiece.

OBJECTS OF THE INVENTION

It is therefore an object of the present invention to provide an improved chain-type cutting assembly.

Another object is the provision of such an improved chain-type cutting assembly that overcomes the above-given disadvantages, in particular for cutting of foam, nonwoven, or rubber products, as well as composite products composed thereof with these products as much as possible being cut and not sawed without removing material, or removing only very little material.

SUMMARY OF THE INVENTION

An assembly for cutting foam, nonwoven, rubber, and composite products has according to the invention a guide having a longitudinally extending guide edge formed with a longitudinally extending and outwardly open groove. A longitudinally extending row of cutting elements extends along the guide edge, and element each has an entrainment dog projecting inward into the groove, a support riding on the guide edge and having sides each formed with a pair of longitudinally spaced and outwardly open recesses, a base outward of the support, and a wedge-section cutting tooth forming a cutting edge outside the base and having a pair of longitudinally extending flanks converging at the cutting edge. Coupling links extend between and have ends set in the recesses of adjacent cutting elements. Pivot pins extend through the ends of the links and through the supports at the bases. The base is of a maximum width greater than a width of the assembly at the pins.

According to the invention, the cross-section of the cutting elements can be have a single step or multiple steps.

In an advantageous approach, the cutting elements are arranged in a row without gaps. The result is that removal of material is especially low. A rowed arrangement that includes gaps is also possible however.

According to the invention, the edge form of the cutting edge of the cutting teeth can be flat and/or serrated and/or toothed and/or with offset toothing.

An advantageous approach has been found whereby the base or base width of the cutting elements corresponds to the maximum width of the cutting chain and the chain guide.

The cutting chain is preferably an endless loop.

According to the invention, the cutting assembly can be provided with a drive unit and a slide rail is provided on the front side thereof. A chain guide groove receiving the cutting chain extends around the edge of the rail. A return formation is provided at the front tip of the slide rail so the chain can move back toward the drive unit where the pusher dogs are engaged by a drive sprocket.

BRIEF DESCRIPTION OF THE DRAWING

The above and other objects, features, and advantages will become more readily apparent from the following description, reference being made to the accompanying drawing in which:

FIG. 1 is a perspective view of a cutting element for a cutting assembly according to the invention;

FIG. 2 is a perspective view of part of a cutting apparatus having a chain of cutting elements as shown in FIG. 1; and FIG. 3 is an end view of a cutting assembly as shown by arrow III in FIG. 2.

SPECIFIC DESCRIPTION OF THE INVENTION

As seen in FIG. 1, a cutting element 1 or link has a tooth 2 extending outward from a base 3 of the cutting element 1. A support 4 inward of the base has laterally open recesses 5 formed with respective holes 6, as well as a pusher dog 7 as a drive and guide component projecting in ward from the tooth base 3. The edge form of the cutting edge of the cutting tooth 2 can be flat, serrated, toothed, or with offset toothing as a function of requirements or specifications.

FIG. 2 shows how a cutting apparatus 8 has a cutting chain 9 formed by a plurality of the cutting elements 1, of which only three are shown by way of example.

The cutting elements 1 are held and guided in a groove 11 of an elongated metal blade, saw bar, or guide rail 10. The cutting elements 1 are articulated at both ends on 8-shaped links 12 and connecting pins or rivets 13 that pass through the holes 6. The cutting elements 1 are in a row with no gaps so as to produce an effective slicing action. In fact the cutting elements 1 have planar leading and trailing end faces 1*a* that abut flatly as shown in FIG. 2 when they run along the straight guide edge of the bar 10.

The cutting chain 9 is guide around an unillustrated rounded end of the rail 10 like a saw chain of a chain saw. Chain saws of this type including corresponding chain guides are well-known and are used primarily for cutting wood. On the straight edges of the rail 10 the end faces 1*a* of the teeth 2 and bases 2 abut each other longitudinally with no gap, forming a single continuous cutting edge 2*a* aimed more at slicing the workpiece than cutting it with chip or material removal.

The end view of FIG. 3 shows that the teeth 2 are of wedge section with opposite planar faces 2*b* forming a small acute angle with each other and meeting at the straight outer cutting edge 2*a*. The base 3 also has planar outer faces 3*a* that form a somewhat larger angle of less than 90° and that extend inward (downward in the figures) from inner edges of the faces 2*b* of the respective tooth 1. Thus the outer faces 2*b*, 3*a* of the cutting assembly 1 is stepped but of uniform sectional shape along its full length (perpendicular to view of FIG. 3), although they can also be formed without steps or as a single step.

The recesses 5 receiving the rounded ends of the connecting links 12 are formed on each lateral side of each cutting element 1 and are of such a depth that the bases 3 have a maximum width W generally equal to the width w of the respective connecting links 12 and rivets 13, thereby producing the narrowest design possible. This yields the smoothest possible overall lateral surface for the cutting chain 9, thereby also avoiding detrimental edges.

The invention thus relates to cutting assembly 8 comprising the cutting chain 9 formed by a row of cutting elements 1, and the geometry of the cutting edges is designed for cutting foam, nonwoven, rubber, and composite products. The row of cutting elements 1 can be implemented with and without gaps between cutting elements 1. The number and distribution of connecting links 12 and cutting elements 1 are arranged to match the optimum cutting result.

The cross-sectional shape of the cutting elements 1 has a single step or multiple steps. The base width W corresponds to the overall chain width w including chain guide. This approach prevents the cutting surfaces from being damaged, while the removed material is moved around the cutting chain and the guide thereof without detrimental edges.

The functional difference between cutting chain and saw chain is essentially that material is cut with no removal or only a small removal of material.

I claim:

1. An assembly for cutting foam, nonwoven, rubber, and composite products, the assembly comprising:

a guide having a longitudinally extending and straight guide edge formed with a longitudinally extending and outwardly open groove;

a longitudinally extending row of cutting elements extending along the guide edge and each having an entrainment dog projecting inward into the groove, a support riding on the guide edge and having sides each formed with a pair of longitudinally spaced and outwardly open recesses, a base outward of the support, and a wedge-section cutting tooth forming a cutting edge outside the base and having a pair of longitudinally extending side flanks converging at the cutting edge, the cutting edges of the cutting elements all being longitudinally aligned along the guide edge and parallel to the guide edge;

coupling links extending between and having ends set in the recesses of adjacent cutting elements; and pivot pins extending through the ends of the links and through the supports, the base being of a maximum width measured transverse to the guide edge greater than a length of the pins.

2. The cutting assembly defined in claim 1, wherein the side flanks are each formed by a planar outer face remote from the respective base and a planar inner face close to the base and longitudinally contiguous with the respective outer face.

3. The cutting assembly defined in claim 2, wherein the planar outer faces of each cutting element form a smaller acute angle with each other than the respective planar inner faces.

4. The cutting assembly defined in claim 1, wherein the teeth of the cutting elements abut one another along a longitudinal axis and the straight guide edge.

5. The cutting assembly defined in claim 4, wherein each of the teeth has leading and trailing end faces that longitudinally abut trailing and leading end faces of adjacent teeth.

6. The cutting assembly defined in claim 5, wherein the end faces are planar and extend perpendicular to the guide edge.

7. The cutting assembly defined in claim 1, wherein the cutting edges are straight and parallel to the guide edge.

8. An assembly for cutting foam, nonwoven, rubber, and composite products, the assembly comprising:

a guide having a longitudinally extending and straight guide edge formed with a longitudinally extending and outwardly open groove;

a longitudinally extending row of cutting elements extending along the guide edge and each having an entrainment dog projecting inward into the groove, a support riding on the guide edge and having sides each formed with a pair of longitudinally spaced and outwardly open recesses, a base outward of the support, and a wedge-section cutting tooth forming a cutting edge outside the base and having a pair of longitudinally extending side flanks converging at the cutting edge and longitudinally oppositely directed end faces extending substantially perpendicular to the guide edge, the cutting edges of the cutting elements all being longitudinally aligned along the guide edge and parallel to the guide edge, the teeth being of such a length that the end faces of adjacent cutting elements longitudinally directly abut one another along the guide edge;

coupling links extending between and having ends set in the recesses of adjacent cutting elements; and pivot pins extending through the ends of the links and through the supports, the base being of a maximum width measured transverse to the guide edge greater than a length of the pins.

* * * * *